United States Patent [19]

Engel

[11] Patent Number: 4,700,279

[45] Date of Patent: Oct. 13, 1987

[54] SPOTLIGHT INCORPORATING A POWER SUPPLY

[76] Inventor: Hartmut S. Engel, Schloss Heutingsheim, 7141 Freiberg am Neckar, Fed. Rep. of Germany

[21] Appl. No.: 877,316

[22] Filed: Jun. 23, 1986

[30] Foreign Application Priority Data

Jun. 21, 1985 [DE] Fed. Rep. of Germany ..... 3522275

[51] Int. Cl.[4] ..... F21V 29/00

[52] U.S. Cl. ..... 362/264; 362/269; 362/294

[58] Field of Search ..... 362/263, 264, 265, 269, 362/294, 296, 304, 341, 345, 347, 350, 427

[56] References Cited

U.S. PATENT DOCUMENTS 3,194,957 7/1965 Caldwell et al. ..... 362/264

3,551,667 12/1970 Husby et al. ..... 362/263 X

*Primary Examiner*—Stephen F. Husar

[57] ABSTRACT

A spotlight is described which is equipped with a power supply circuit wherein the power supply circuit is constructed as a group of components arranged in a ring-like housing which surrounds the jacket which accommodates the reflector. The ring-like housing is clampingly held by, and spaced apart from, the central part which is made of metal. Moreover, the overall arrangement is pivotable about the carrier tube through the which the feedlines pass.

15 Claims, 3 Drawing Figures

SPOTLIGHT INCORPORATING A POWER SUPPLY

Figure 1:
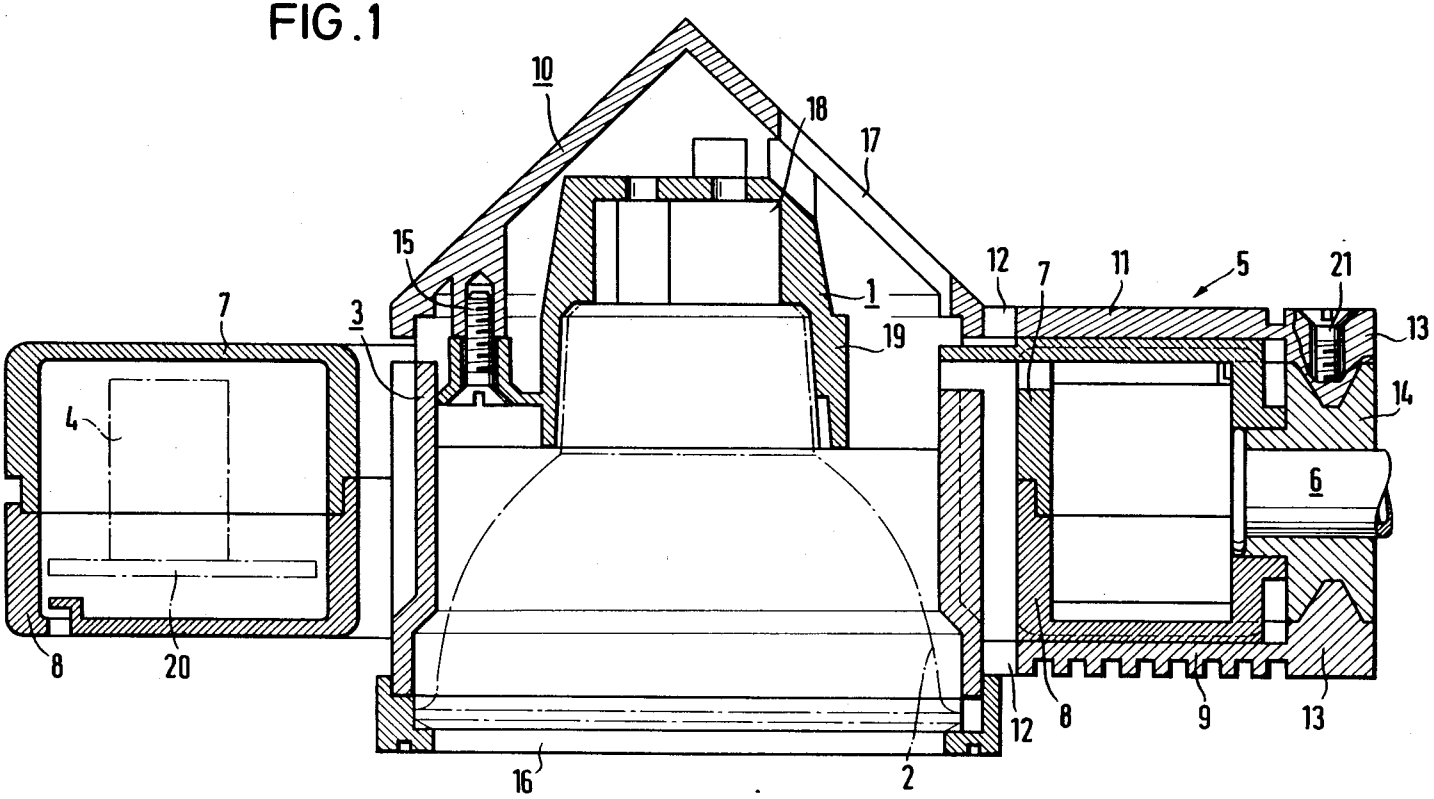

The invention relates to a spotlight, in particular for use with halogen bulbs, the spotlight comprising a bulb holder; a jacket surrounding a reflector; a power supply circuit; and a carrier unit with an integrated feedline.

Known spotlights of this kind, which are intended for connection to the main supply voltage and which are operated at a central frequency of for example 10 kHz, give rise to problems, on the one hand with regard to protection against disturbing radiation, and, on the other hand, are generally unsatisfactory from the point of view of their appearance because the electrical or electronic components have a considerable space requirement which hinders and impairs the possibilities for designing the shape of the spotlight.

The principal object of the present invention is to develop a spotlight of the initially named kind so that problems due to radiative interference are practically eliminated, so that the electrical and/or electronic components are integrated into the overall construction without impairing the spatial adjustability of the spotlight and so that good heat dissipation is achieved which ensures a high degree of operational reliability.

This object is satisfied essentially in that the power supply circuit is designed as a group of components arranged in a ring-like housing surrounding the jacket; in that the bulb holder and the jacket are combined into a central part and are provided with a first projection which extends in the radial direction and forms a part of the carrier unit; in that a cover part which extends over at least the bulb holder is connected with the central part and is provided with a second projection which extends in the radial direction and likewise forms a part of the carrier unit; and in that the ring-like housing is held spaced from the central part by being clamped between the first and second projections.

The cover part and also the central part with the projections which clampingly hold the ring-like housing are metallically executed and thus simultaneously form an electrical screen whereby, as a result of the layout of the power supply circuit as a group of components in a ring, extremely short secondary lines can be achieved, which are thus secure against disturbing radiation. The accommodation of the power supply circuit in a ring-like housing leads, on the one hand, to a favourable weight distribution having regard to the possibilities of adjusting the spotlight and, on the other hand, to an ideal integration of the electrical and electronic components necessary for the operation of the spotlight into the appearance of the spotlight, from the point of view of the layout, without impairing the technical requirements.

One such technical requirement is, above all, the leading away of the heat which arises in operation. In this respect it is of advantage that the metallically executed central part with the associated cover part can take on the function of a heat dissipating body in addition to its function as an electrical screening unit, with the heat dissipating body protecting the ring-like housing containing the electronic components from disturbing thermal loading, and being connected with the ring-like housing for this purpose merely via webs which are formed between the central and cover parts and the clamping regions.

The ring-like housing which accommodates the power supply circuit preferably consists of two half shells of synthetic material which are approximately U-shaped in cross-section which engage within one another in form-locked manner and which are expediently provided with a plurality of openings at the base and at the ceiling side, with the openings being distributed around the periphery and preferably being constructed as slits.

The two clamping projections, which are respectively formed on the central part and on the cover part for the ring-like housing, have axially directed flanges at their radially outwardly disposed ends which can be mutually screwed together and in which confronting semi-circular recesses are formed for receiving a mounting or bearing part for the carrier tube. The carrier tube is a metal tube which accommodates the electrical feedlines in screened manner and which is rotatably held in the mounting part. The mounting part can be pivoted over 360° relative to the carrier tube but cannot however be rotated beyond this angle.

The bulb holder and jacket are preferably constructed in one piece and are mutually fixed with the cover part preferably via a single connection position by means of a screw. In this manner the overall construction of the spotlight is achieved with a minimum of parts, which ensures that the spotlight is particularly economical to manufacture and to assemble and install.

A further advantageous feature of the invention lies in the fact that the mount for the particular lighting means and the associated jacket is constructed as a unit mount for different lighting means, so that for the same basic structure of the spotlight construction lights of different kinds and with different angles of radiation can be used. In practice this means that stock holding is made substantially easier because only one type of spotlight need be kept in store and a combination of the spotlight with a series of different lighting means. e.g. with different reflector and/or bulb shapes and types is possible.

Further advantageous features of the invention are set forth in the subordinate claims.

Figure 2:
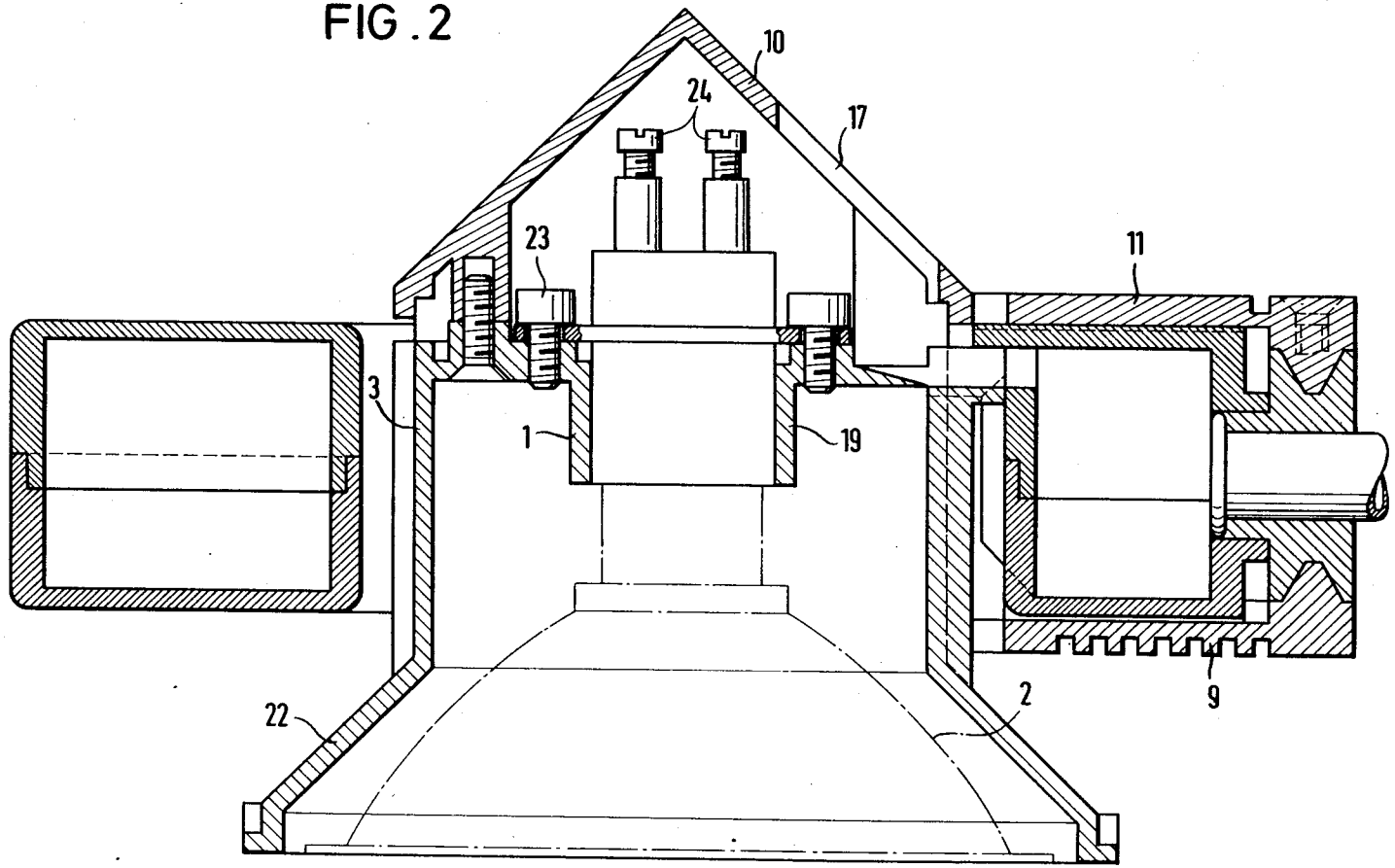
Figure 3:
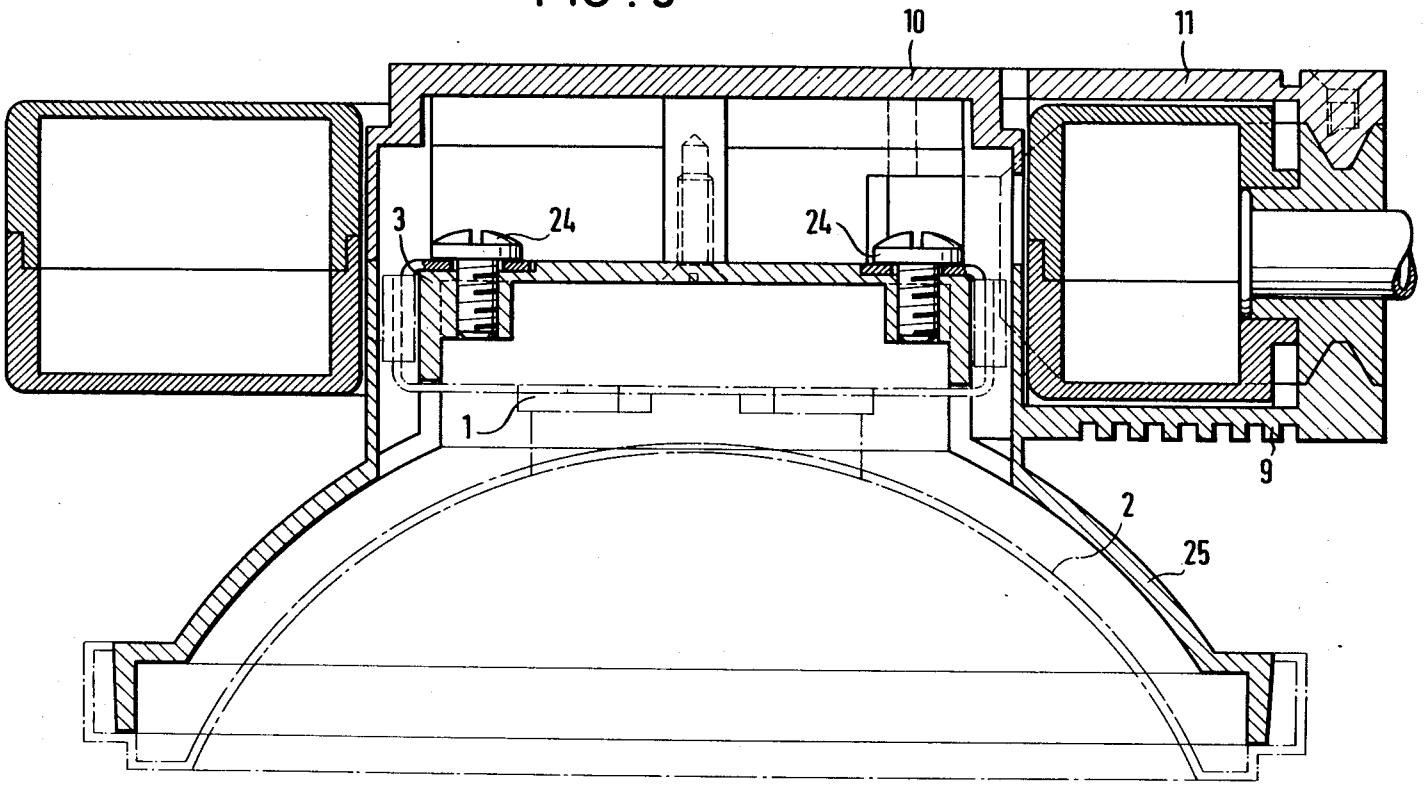

Embodiments of the invention will now be described in more detail with reference to the drawings in which are shown:

FIG. 1 a vertical section of a first embodiment of a spotlight in accordance with the invention, FIG. 2 a schematic vertically sectioned view of a variant of the spotlight of FIG. 1, and FIG. 3 a further vertically sectioned representation of a modified embodiment of the spotlight of FIG. 1.

A metallic bulb holder 1 with a mounting chamber 18 for a lamp socket and a ring-like region 19 for accommodating reflector 2 is connected with a likewise metallic substantially cylindrical jacket 3 and is in particular combined into a single one piece central part. A mounting ring 16 for the reflector 2 is provided at the free end of the jacket 3. The mutual connection of the mounting ring 16 and the jacket 3 can for example take place via a bayonet connection and the mounting ring can simultaneously serve to fix a light diffusing screen or the like.

A likewise metallic cover part 10 is fixedly secured with the central unit 1, 3 via a screw element 15. This cover part 10 has, in the illustrated embodiment, the shape of a cone with an apex angle of approximately 90°, however it is evident that the outer shape of this cover part is not restricted by technical requirements to the form selected in this embodiment, which is the form preferably used in practice. For the purpose of achieving good thermal dissipation the cover part 10 is provided with a plurality of slots 17 distributed around the periphery.

Via webs 12 a first projection 11 is connected with the cover part 10 and a second projection 9 with the jacket 3. Both projections lie in planes perpendicular to the longitudinal axis of the central part 1, 3 and are mutually spaced apart, which makes possible a clamped form-locked mounting of a ring-like housing 7, 8. The ring-like housing 7, 8 surrounds the central part, is spaced therefrom by a predeterminable distance and serves to accommodate a power supply circuit 4. The ring-like housing consists of a lower half shell of approximately U-shaped cross-section and an upper half shell 7 which is likewise of approximately U-shaped cross-section, with the half shells being coupled with one another in form-locked manner. The individual electrical or electronic components of the power supply circuit 4 are arranged on a ring plate 20, which is preferably constructed a a circuit board in such a way that on the one hand a weight distribution is obtained which is as uniform as possible and on the other hand the secondary line lengths are minimised.

The two projections 9, 11 are provided at their radially outwardly disposed ends with flange parts 13 which extend in the axial direction, with confronting symmetrical recesses for accommodating a mounting part 14 for a carrier tube 6 being provided in the flange parts 13.

These axial flanges 13 are clamped against one another by means of throughgoing screws which are arranged at the sides and simultaneously clamp the mounting part 14. This clamped connection of the projections 9, 11 results, together with the single connecting screw 15 between the central part 1, 3 and the cover part 10, in a mutual fixing of the individual components with a minimum of connection elements.

As the reflector 2 or the bulb are fixed via the holding ring 16 and as this can take place after assembing has been completed the screw 15 is easily accessible, i.e. all connecting elements 15, 21 are accessible without problem, and thus extremely simple assembly of the spotlight is ensured.

As a result of the free ring space between the jacket 3 and the ring-like housing 7, 8 a cooling chimney effect occurs in operation between these components, which keeps the temperature of the electronic components which are always provided in the housing at a low level. Thermal loading of the ring-like housing via the projections 9 and 11 is likewise minimised because the connection between these projections 9, 11 and the central part 1, 3 and the cover part 10 is effected via narrow webs 12 which represent thermal barriers.

The carrier tube 6 is provided at its free end with a ring flange. The mounting part 14, and thus the entire spotlight, can be pivoted about the carrier pipe 6 through 360°, cannot however be turned beyond this angle, i.e. cannot be rotated continuously. In this respect it is of particular advantage that low bearing loads arise as a result of the uniform weight distribution and the spotlight will remain stationary in any selected rotary position without the requirement to use special clamping devices, which leads to a high degree of variability of the possibilities of using the spotlight.

The carrier tube 6 is provided at its non-illustrated end remote from the spotlight with an adaptdr of customary construction which can likewise be rotatable through 360°. The combined rotatability of the adaptor and the spotlight result in an optimum number of degrees of freedom, and thus possibilities of using the spotlight.

The embodiment of FIG. 2 is distinguished from the embodiment described in connection with FIG. 1 in principle in that a modified bulb holder 1 with a jacket 3 matched to the reflector is inserted into the spotlight. The jacket 3 consists in this arrangement of a cylindrical portion located within the ring-like housing 9 and a conical portion 22 which adjoins this cylindrical portion.

FIG. 2 makes it clear in principle that the most diverse lighting means can be inserted into the reflector, i.e. the basic structure of the spotlight can be combined with the most diverse lighting means. The angle of radiation of the spotlight is accordingly varied via th lighting means and the lighting means also determine whether the thermal radiation takes place to the front or to the rear. The spotlight is so designed that it permits both possibilities without being impaired in its ability to operate permanently.

The mounting of the bulb holder 1 via screws as shown in FIG. 2 has proved to be particularly simple, and the electrical connections can be effected without problem via the clamping screws 24.

The embodiment shown in FIG. 3 has the same basic construction as the proceeding variants, and shows that the spotlight can also be equipped with lighting means which are provided with a comparatively large partly spherical reflector with a correspondingly matched jacket 25. The conical cover part 10 which has been described in the previous embodiments is made flat in case of FIG. 3, which does not however lead to any substantial distinctions in operation.

The connnecting or terminal screws 24 are easily accessible when the cover part is removed, and the cover part can in turn be easily connected with the bulb holder via a centrally disposed screw.

The invention thus provides a spotlight which is constructed from a minimum of individual parts, which ensures screening against disturbing radiation which meets all the requirements in practice, which exhibits a thermal decoupling of the actual lamp part and the electronic part, and which results, as a low weight arrangement, in greater of freedom with regard to the spatial positioning of the spotlight.

The provision of a basic structure for the spotlight which can be combined with the most diverse lighting means and which permits in practice the use of all kinds of halogen lamps provides a high degree of variability for the user and substantially simplifies the storage problem for the dealer, as a result of the many possibilities of combining the spotlight with different lighting means.

What is claimed:

1. A spotlight comprising a reflector having a curved reflective side wall, a narrow end and a broad end; a jacket surrounding said side wall of said reflector; a bulb holder disposed at said narrow end of said reflector and having an end facing away from said reflector; a cover covering said end of said bulb holder facing away from said reflector; means connecting said bulb holder, said jacket and said cover together to form a central part; a ring-like housing surrounding said jacket and spaced apart from said central part; a first projection extending radially outwardly from said jacket adjacent said broad end of said reflector; a second projection extending radially outwardly from said cover; means for clamping said ring-like housing between said first and second projections to secure said housing relative to said central part; and a carrier unit including a carrier tube for supporting said spotlight, said carrier tube having a mounting part clampingly received between said first and second projections; said ring-like housing accommodating a power supply circuit for said spotlight and being connected to a feedline integrated into said carrier unit.

2. A spotlight in accordance with claim 1, wherein said first and second projections are respectively connected with said jacket and said cover part via respective webs.

3. A spotlight in accordance with claim 1, wherein said ring-like housing comprises two half shells, each of substantially U-shaped cross section, and engaging within one another in a form-locked manner.

4. A spotlight in accordance with claim 1, wherein said ring-like housing has base and ceiling sides adjacent said broad and narrow ends of said reflector respectively; and a plurality of openings distributed around said base and ceiling sides.

5. A spotlight in accordance with claim 1, wherein said first and second projections have axially directed flanges at their radially outwardly disposed ends; wherein said means for clamping said ring-like housing between said first and second projections comprises first and second screws extending between said axially directed flanges; and wherein said axially directed flanges have respective symmetrically disposed cutouts for receiving said mounting part.

6. A spotlight in accordance with claim 1, wherein said bulb holder and said jacket are formed in one piece and are connected with said cover part at at least one connection location by at least one screw.

7. A spotlight in accordance with claim 6, wherein said connection location is disposed in a central place extending through said carrier tube diametrically opposite said carrier tube.

8. A spotlight in accordance with claim 1, wherein said bulb holder and said jacket together form an exchangeable unit.

9. A spotlight in accordance with claim 1, wherein a range of different jackets is provided for use with different reflectors.

10. A spotlight in accordance with claim 1, wherein said jacket consists of a cylindrical part disposed within said ring-like housing and a shade part which broadens conically and which adjoins said cylindrical part.

11. A spotlight in accordance with claim 1, wherein said jacket consists of a cylindrical part disposed within said ring-like housing and a shade part which broadens spherically and which adjoins said cylindrical part.

12. A spotlight in accordance with claim 1, wherein said bulb holder is adapted to accommodate a halogen bulb.

13. A spotlight in accordance with claim 3, wherein said ring-like housing consists of synthetic material.

14. A spotlight in accordance with claim 1, wherein said central part consists of metal.

15. A spotlight in accordance with claim 1, wherein said ring-like housing is spaced from said central part to define a chimney therebetween for promoting flow of cooling air past said central part.

* * * * *